US007389818B2

(12) United States Patent
Høiland

(10) Patent No.: US 7,389,818 B2
(45) Date of Patent: Jun. 24, 2008

(54) METHOD AND DEVICE BY A DISPLACEMENT TOOL

(76) Inventor: Oddgeir Høiland, Normannag. 37, Stavanger (NO) N-4014

( * ) Notice: Subject to any disclaimer, the term of this patent is extended or adjusted under 35 U.S.C. 154(b) by 317 days.

(21) Appl. No.: 10/525,261

(22) PCT Filed: Aug. 21, 2002

(86) PCT No.: PCT/NO02/00289

§ 371 (c)(1),
(2), (4) Date: Feb. 22, 2005

(87) PCT Pub. No.: WO2004/018832

PCT Pub. Date: Mar. 4, 2004

(65) Prior Publication Data

US 2006/0201680 A1 Sep. 14, 2006

(51) Int. Cl.
*E21B 29/12* (2006.01)

(52) U.S. Cl. ..... 166/367; 166/359; 166/345; 405/224.4

(58) Field of Classification Search ..... 166/367, 166/359, 358, 352, 350, 345, 340; 405/224.2–224.4
See application file for complete search history.

(56) References Cited

U.S. PATENT DOCUMENTS

| | | | | |
|---|---|---|---|---|
| 3,575,237 | A * | 4/1971 | Malone | 166/152 |
| 3,894,814 | A | 7/1975 | Morgan | |
| 4,009,753 | A | 3/1977 | McGill et al. | |
| 4,042,014 | A * | 8/1977 | Scott | 166/367 |
| 4,334,582 | A * | 6/1982 | Baker et al. | 166/355 |
| 4,378,850 | A * | 4/1983 | Barrington | 166/373 |
| 4,522,370 | A | 6/1985 | Noack et al. | |
| 4,659,530 | A * | 4/1987 | Boyers et al. | 264/315 |
| 5,443,241 | A * | 8/1995 | Odaira et al. | 251/129.07 |
| 6,253,854 | B1 | 7/2001 | Fenton | |
| 6,325,159 | B1 * | 12/2001 | Peterman et al. | 175/7 |
| 6,450,262 | B1 * | 9/2002 | Regan | 166/350 |
| 6,571,880 | B1 * | 6/2003 | Butterfield et al. | 166/386 |
| 7,112,011 | B2 * | 9/2006 | McCarty et al. | 405/224.4 |
| 2005/0152749 | A1 * | 7/2005 | Anres et al. | 405/224 |
| 2007/0256864 | A1 * | 11/2007 | Robichaux et al. | 175/57 |

FOREIGN PATENT DOCUMENTS

| | | |
|---|---|---|
| GB | 2320268 A | 6/1998 |
| NO | B1 309396 | 1/2001 |
| NO | B1 310694 | 8/2001 |

OTHER PUBLICATIONS

International Search Report dated Mar. 13, 2003.
Norwegian Search Report dated Sep. 13, 2001.

* cited by examiner

*Primary Examiner*—Thomas A Beach
(74) *Attorney, Agent, or Firm*—Andrus, Sceales, Starke & Sawall, LLP

(57) ABSTRACT

A method and device for use in the replacing of liquid in a riser (12) of the kind used in the recovery of petroleum offshore, wherein the riser (12) forms a connection between a wellhead (4) on or above the sea floor (6) and a drilling vessel (1), and wherein a body (30), which is arranged to keep the liquids separate, is displaced longitudinally of the riser (12).

19 Claims, 5 Drawing Sheets

METHOD AND DEVICE BY A DISPLACEMENT TOOL

CROSS REFERENCE TO RELATED APPLICATION

The present application is the U.S. national stage application of International Application PCT/NO2002/000289, filed Aug. 21, 2002, which international application was published on Mar. 4, 2004 as International Publication WO 2004/018832.

BACKGROUND OF THE INVENTION

This invention relates to a method which is arranged to prevent the mixing of liquids in a riser of the kind utilized in the recovery of petroleum offshore. The invention also comprises a device for practicing the method.

In petroleum recovery offshore it is usual for a wellhead to be placed on the sea floor over the well opening in an early phase of the drilling work. The wellhead which is sealingly connected to the casing of the well, is provided with necessary blow-out preventers (BOPs) and connectors, for among other things a riser connecting the wellhead to a drilling vessel at the sea surface. In the drilling phase the well and riser are filled with drilling fluid.

A drill pipe/drill string which is provided with a drill bit at its lower end portion, is run from the drilling vessel through the riser, wellhead and further down into the well through the casing of the well to the bottom of the well, where the drilling takes place. Drilling fluid is circulated down the drill pipe to the drill bit, from where it flows, carrying cuttings, back to the drilling vessel, in the annulus between the drill pipe and casing/riser.

The riser is normally provided with several external smaller pipes (choke and kill pipes), which extend parallel to the riser and are connected at their upper end portions to processing equipment on the drilling vessel, whereas at their lower end portions they are connected to the wellhead at suitable points between the BOPs. The pipes may be used, for example, to replace the drilling fluid in the well if the well pressure increases in such a way that the riser, which normally has atmospheric pressure at the surface, must be shut off at the wellhead to prevent undesired outflow of drilling fluid.

In drilling it happens that bad weather, for example, makes disconnection of the drilling vessel from the well necessary. By such disconnection it is common that the part of the drill pipe located underneath the wellhead is hung off by means of an appropriate tool. The drill pipe portion located above the hanger tool is disconnected from it and pulled up. A valve in the wellhead is closed, thereby shutting off the lower portion of the drill pipe within the well. Thus, it is not necessary to pull up the entire drill pipe, which may take a long time.

After the lower portion of the drill pipe has been hung off and shut in within the well, the upper portion of the drill pipe is pulled up from the wellhead, as mentioned. However, before disconnecting the riser from the wellhead, the drilling fluid present in the riser must be replaced with water. The purpose of replacing the fluid is to take care of the well fluid and prevent it from contaminating the environment. Normally this is done by pumping water down to the wellhead through the external smaller pipes, so that the water displaces the drilling fluid out of the riser into the collecting tanks of the drilling vessel. Then the riser is disconnected from the wellhead.

It is a problem that in such replacing of fluid in the riser, in the area of contact of the two fluids, there is a considerable mixing of fluids. Drilling fluid thus becomes contaminated with water. Purification or destruction of such contaminated drilling fluid is relatively expensive.

SUMMARY OF THE INVENTION

The invention has as its object to remedy the drawbacks of the known method.

The object is achieved according to the invention through the features specified in the description below and in the following Claims.

When the drilling vessel is to be disconnected from the wellhead, the drill string is provided, maybe near the hanger tool, with a piston or some other device which is arranged to keep fluids separate. The piston may possibly form part of the hanger tool. The outer diameter of the piston is adapted to the inner diameter of the riser and is provided with a material, preferably along its outer periphery, which is arranged to prevent fluid from flowing past the piston as it is being displaced within the riser. On displacement of the drill pipe provided with said piston and hanger tool down the riser, the piston displaces the drilling fluid present in the riser. The displaced drilling fluid flows up through one or more of the smaller pipes positioned externally on the riser. The pipe volume above the piston is replenished with water. When the lower portion of the drill pipe is hung off in the wellhead, and the upper portion of the drill pipe is disconnected from the hanger tool, the drilling fluid possibly present in the upper portion of the drill pipe may also be replaced with water through the same smaller pipes, one at a time. Thus, the smaller pipes are also filled with water. One of the shut-off devices of the wellhead is closed above the hanger tool and the lower portion of the drill pipe. The piston is then pulled up together with the upper portion of the drill pipe. Then the riser and the smaller pipes are disconnected from the wellhead.

When the drilling vessel is to be reconnected to the wellhead, the riser and the smaller pipes are connected to the wellhead, after which the piston is again run down to the wellhead together with the connector device of the hanger tool. The connector device of the hanger tool is then connected to the hanger tool. The water present in the connection area between the riser and the wellhead is circulated out in that drilling fluid is pumped down the smaller pipe connected the lowermost to the wellhead, and returns up to the drilling vessel through the other smaller pipe. The riser is then replenished with drilling fluid as the piston, together with the hanger tool and drill pipe, is being pulled up through the riser. The clean water which was present in the riser, flows out without being contaminated by the entering drilling fluid. The piston and the hanger tool are dismantled from the drill pipe after having been pulled up to the drilling vessel, before drilling may continue.

The piston or another device arranged to keep liquids separated, may of course be used in a corresponding manner without the use of a hanger tool.

The piston is formed as a sealing element according to technique known in itself. For example, in addition to the piston body the piston may comprise a relatively short drill pipe extending therethrough and being provided at its end portions with threads complementarily matching the drill pipes. Along its outer periphery the piston may be provided with an elastic material arranged to be sealingly displaceable inside the riser.

If desirable, the piston may be provided with one or more controllable flow valves and/or check valves.

BRIEF DESCRIPTION OF THE DRAWINGS

In the following will be described a non-limiting example of a preferred embodiment visualized in the accompanying drawings, in which.

DETAILED DESCRIPTION OF THE INVENTION

Figure 1:
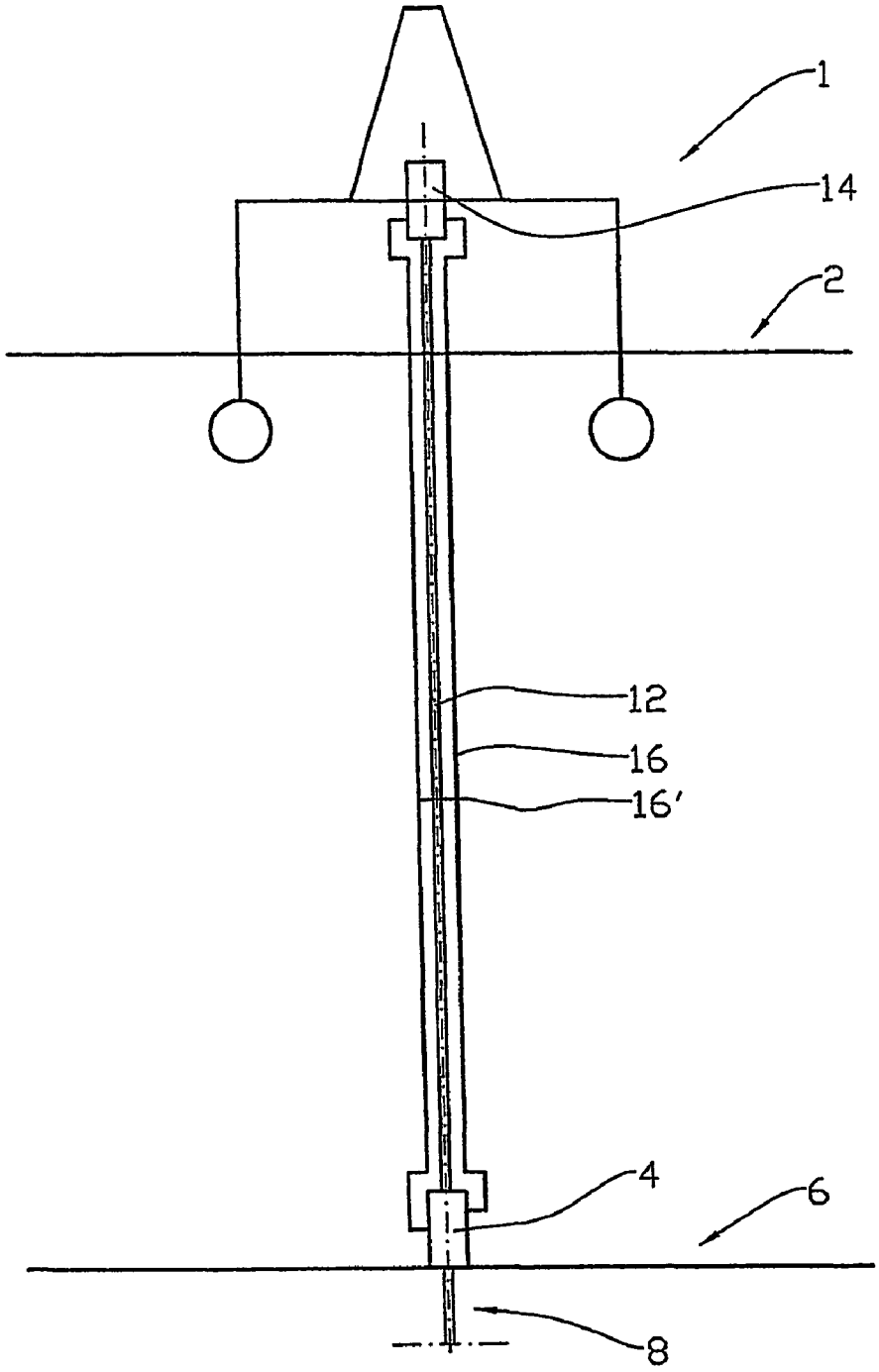
FIG. 1 shows schematically a drilling vessel connected through a riser to a wellhead on the sea floor.

In the drawings the reference numeral 1 identifies a drilling vessel located at the sea surface 2. A wellhead 4 is located on the sea floor 6 and sealingly connected to the casing 10 of a well 8. A riser 10 is sealingly connected to the wellhead and extends through the water up to the connector/processing equipment 14 of the drilling vessel 1. Smaller pipes 16, 16' (choke and kill pipes) extend from the connector/processing equipment 14 of the drilling vessel 1, parallel to the riser 12 down to the wellhead 4, where they are connected at suitable points, possibly through valves not shown, to the cavity of the wellhead 4 through bores 16, 16'. The wellhead is provided with a number of valves, of which one shut-off valve 18, 18' is shown. The wellhead 4 is further provided with a bed 20.

A drill pipe 22 extending down from the drilling vessel 1 is located inside the riser 12 and the well 8. A hanger tool 24 is installed in the drill pipe 22 through connectors 26, 26'.

All devices described so far in the specifying part of the description are of kinds well known in themselves.

A piston 30 comprising a relatively short drill pipe 32 and a piston body 34 is installed in the drill pipe 22 by means of connectors 26', 26". The external diameter of the piston 34 is adapted to the inner diameter of the riser 12 and may be provided with seals 36, 36' of an elastic material arranged to seal against the inner diameter of the riser 12 as the piston 30 is being displaced within the riser 12.

Figure 2:
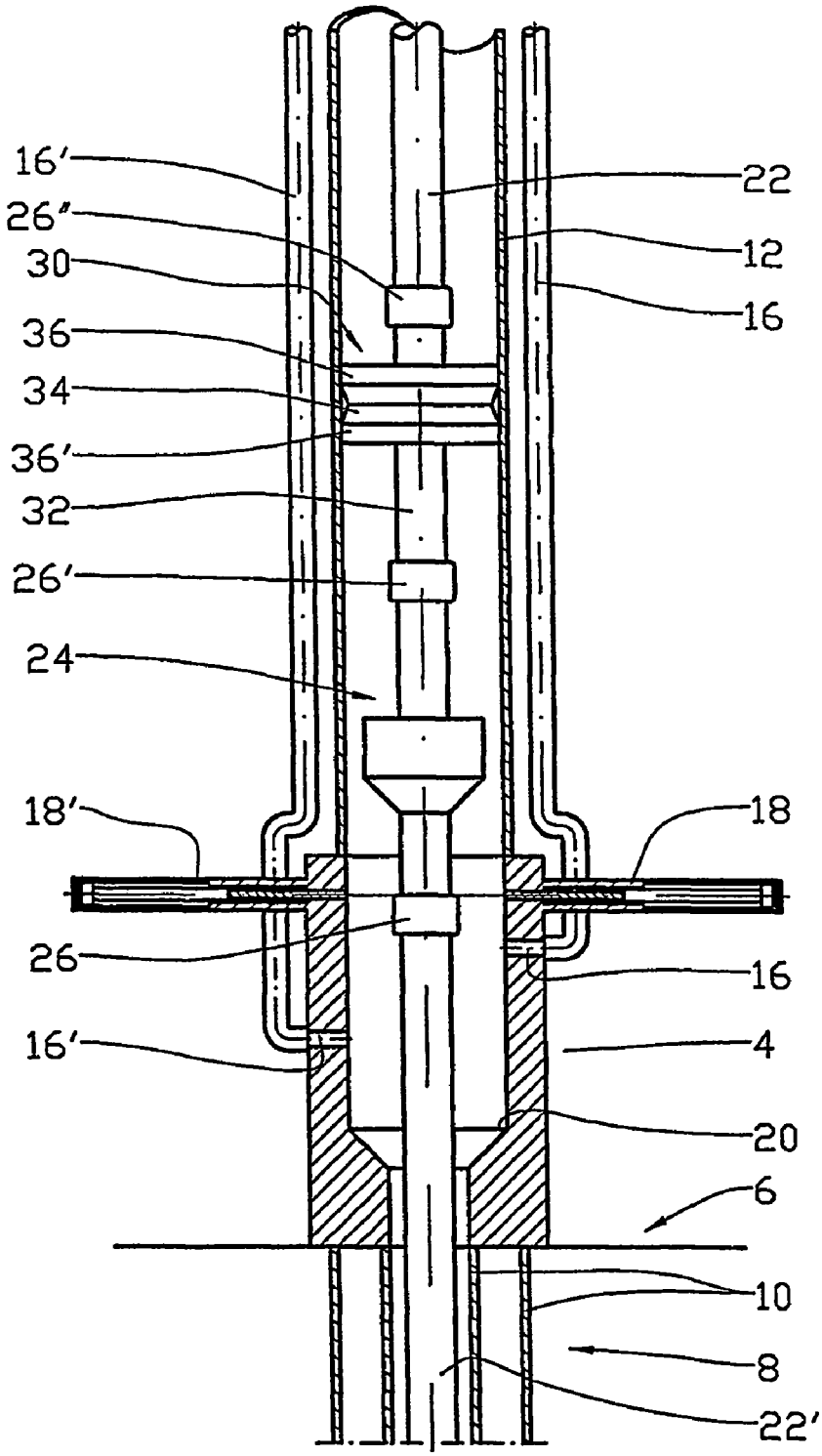
FIG. 2 shows schematically in section a wellhead, in which a hanger tool and a piston of the kind in question are connected to a drill pipe and are located within a riser just above the wellhead.

When the riser 12 and the smaller pipes 16, 16' are to be disconnected from the wellhead 4, the drill pipe is pulled up by a length at least corresponding to the sea depth at the site of drilling. A hanger tool 24 and a piston 30 are installed between two sections of the drill pipe 22. The drill pipe 22 with the connected hanger tool 24 and piston 30, is then lowered down, see FIG. 2. Drilling fluid present below the piston 30 in the riser 12 is displaced during the lowering of the piston 30, flowing up to the drilling vessel through the smaller pipes 16, 16'. Water is supplied to the riser 12 above the piston 30.

Figure 3:
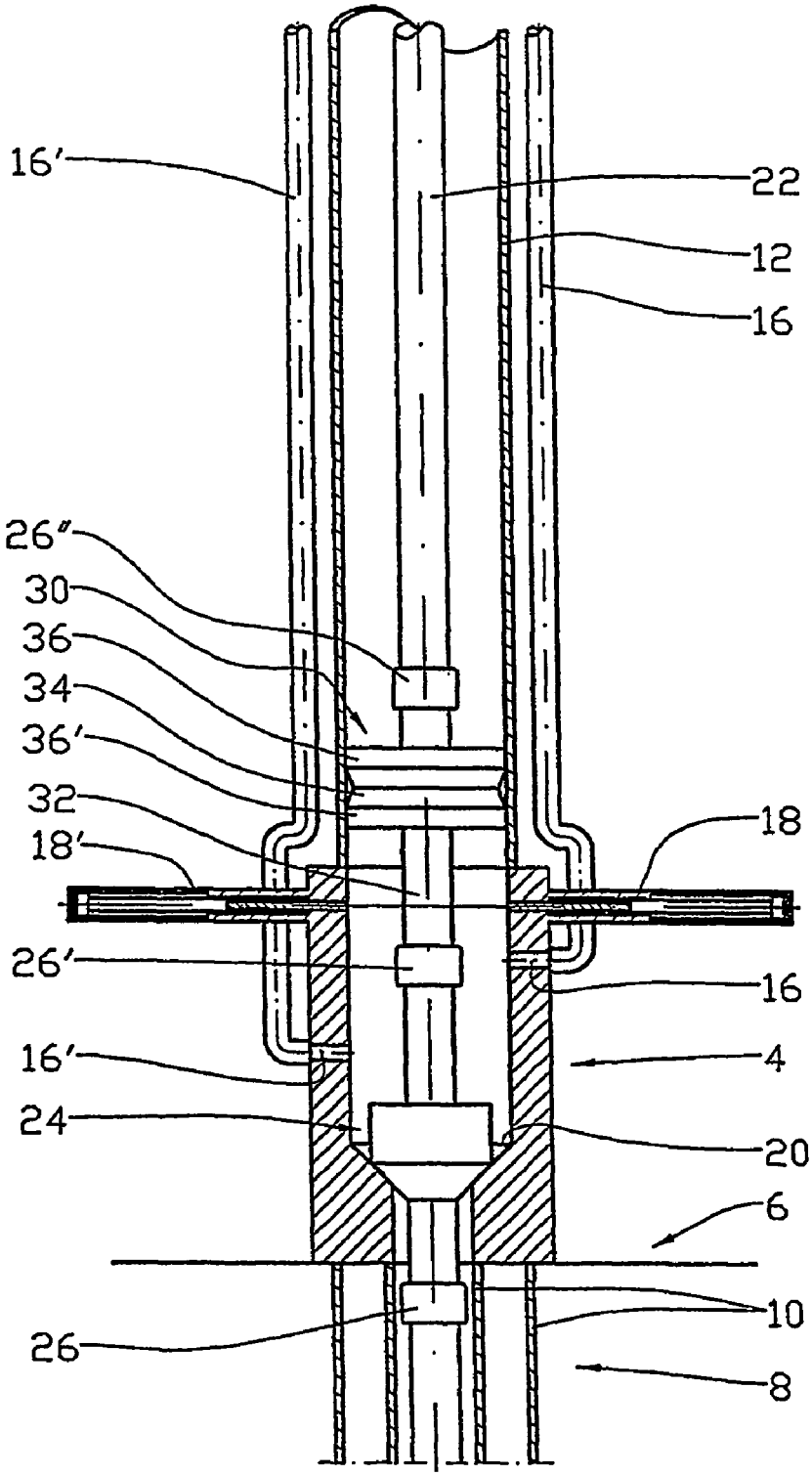
FIG. 3 shows schematically in section the wellhead of FIG. 1, but here the hanger tool has come to abut the wellhead.

When the hanger tool 24 comes to abut the bed 20 of the wellhead 4, the piston 30 is just above the wellhead 4, see FIG. 3. Thus, the major part of the drilling fluid that was in the riser 12, has been displaced.

Figure 4:
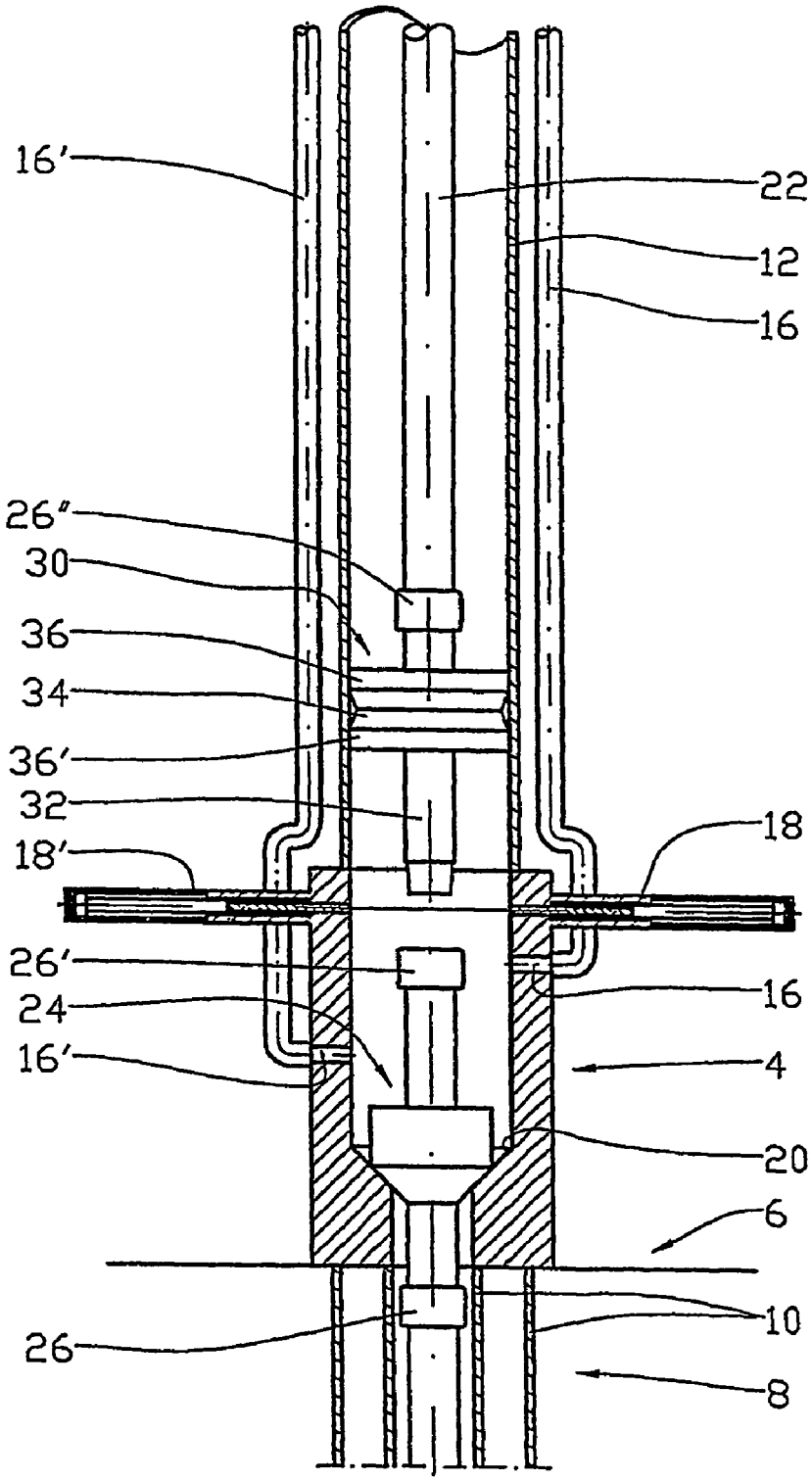
FIG. 4 shows schematically in section the wellhead of FIG. 1, but there the piston and upper portion of the drill pipe have been disconnected from the hanger tool.

The piston 30 and the upper portion of the drill pipe 22 are disconnected from the hanger tool 24, see FIG. 4. To ensure that the upper end portion of the drill pipe 22 is emptied of drilling fluid, water may be pumped down, if desirable, and will flow back, first through one smaller pipe 16 and then through the other smaller pipe 16'. Alternatively water may be pumped down through one smaller pipe 16' and back through the smaller pipe 16, whereby drilling fluid present in the smaller pipes 16, 16' and wellhead 4 is returned to the drilling vessel 1.

Figure 5:
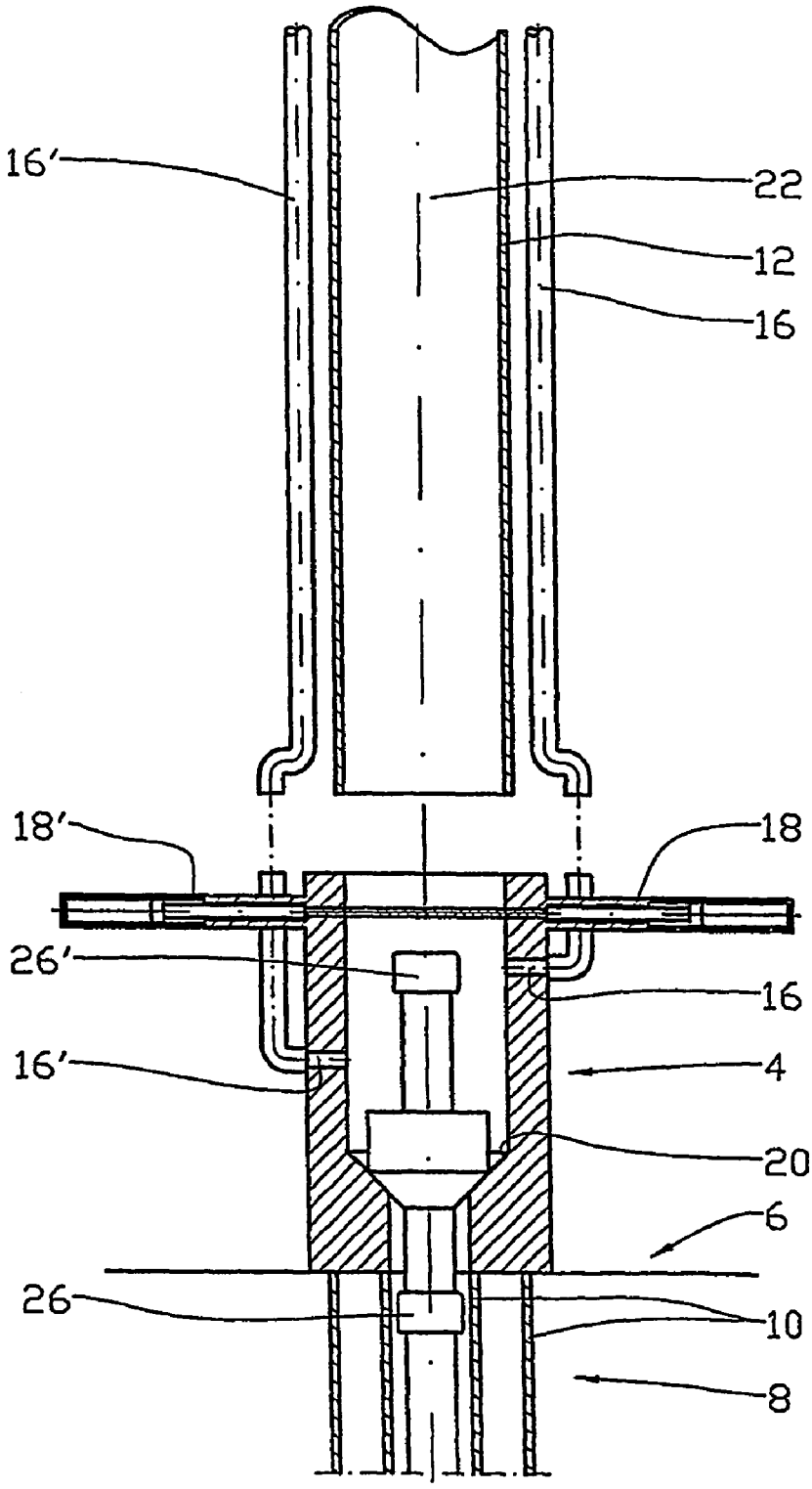
FIG. 5 shows schematically in section the wellhead of FIG. 1, but here one of the shut-off valves of the wellhead has closed the upper opening of the wellhead, and the riser and the smaller pipes have been disconnected from the wellhead.

The shut-off valve 18, 18' of the wellhead 4 is then closed and the riser 12 and the smaller pipes 16, 16' are disconnected from the wellhead 8, see FIG. 5.

When drilling is to be resumed, a liquid replacement is carried out again, as described above, but in reverse order, in that drilling fluid is pumped down through the smaller pipe 16', whereby water in the smaller pipes 16, 16' and wellhead 4 is circulated out through the smaller pipe 16. Circulation continues, so that replenishing with drilling fluid takes place as the piston 30 is being displaced up the riser 12.

The method according to the invention reduces, to a substantial degree, the need for purification and destruction of contaminated drilling fluid. The application of the method will thereby bring considerable economic and environmental profit.

The invention claimed is:

1. A system for replacing liquid in a riser during connection and disconnection of the riser and a subsea wellhead, the system comprising:

a riser connected to a subsea wellhead;

a body connected to a drill pipe, the body comprising a sealing surface that is configured to displaceably seal against an inner wall of the riser and thereby divide the interior of the riser into separate upper and lower riser sections;

the drill pipe and body configured to move downwardly together in the riser towards the wellhead to reduce the volume of the lower riser section and thus forces fluid out of the lower riser section;

the drill pipe and body configured to move upwardly together in the riser away from the wellhead to increase the volume of the lower riser section and thus draw fluid into the lower riser section; and a sealing mechanism configured to close the wellhead.

2. The system of claim 1, comprising a hanger tool connected to or forming part of the body.

3. The system of claim 1, comprising at least one tube connected to the wellhead and configured to receive and introduce fluids from and to the wellhead, respectively.

4. A method for replacing liquid in a riser during connection and disconnection of the riser and a subsea wellhead, the method comprising the steps of:

connecting a body to a drill pipe, the body comprising a sealing surface that is configured to displaceably seal against an inner wall of the riser and thereby divide the interior of the riser into separate upper and lower riser sections;

moving the drill pipe and body together downwardly in the riser towards the wellhead to reduce the volume of the lower riser section and thus force fluid out of the lower riser section; and closing the wellhead.

5. The method of claim 4, further comprising the step of disconnecting the riser from the closed wellhead.

6. The method of claim 4, wherein the wellhead is closed by a sealing valve.

7. The method of claim 4, comprising the step of moving the drill pipe and body downwardly until the body is located proximate the wellhead in order to maximize the amount of fluid forced out of the lower riser section.

8. The method of claim 4, comprising the step of filling the upper riser section with fluid as the drill pipe and body are moved downwardly.

9. The method of claim 4, wherein the drill pipe comprises upper and lower drill pipe sections and the body is connected to the drill pipe between the upper and lower drill pipe sections.

10. The method of claim 9, wherein a hanger tool facilitates connection and disconnection of the upper drill pipe section and the lower drill pipe section.

11. The method of claim 9, comprising the step of disconnecting the upper drill pipe section and the body from the lower drill pipe section prior to closing the wellhead.

12. The method of claim 4, wherein at least one pipe connected to the wellhead receives fluid emitted from the lower riser section as the drill pipe and body are moved downwardly.

13. The method of claim 12, comprising the step of filling the at least one pipe connected to the wellhead with fluid after the wellhead is closed.

14. The method of claim 4, wherein the body comprises a piston.

15. A method for replacing liquid in a riser during connection and disconnection of the lower end of the riser and a subsea wellhead, the method comprising the steps of:

connecting the lower end of the riser to the wellhead;

connecting a body to a drill pipe, the body comprising a sealing surface that is configured to displaceably seal against an inner wall of the riser and thereby divide the interior of the riser into separate upper and lower riser sections;

opening the wellhead; and moving the drill pipe and body together upwardly in the riser away from the wellhead so that the body draws fluid into the lower riser section.

16. The method of claim 15, comprising the step of connecting at least one pipe to the wellhead and wherein fluid is drawn into the lower riser section via the at least one pipe connected to the wellhead as the drill pipe and body are forced upwardly.

17. The method of claim 15, wherein the drill pipe comprises upper and lower drill pipe sections and the body is connected to the drill pipe between the upper and lower drill pipe sections prior to moving of the drill pipe and body upwardly in the riser.

18. The method of claim 17, wherein the body comprises a piston.

19. The method of claim 15, comprising the step of disconnecting the body from the drill pipe prior to commencement of drilling operations.

* * * * *